US009289992B2

(12) United States Patent
Miyajima

(10) Patent No.: US 9,289,992 B2
(45) Date of Patent: Mar. 22, 2016

(54) LIQUID EJECTING HEAD AND LIQUID EJECTING APPARATUS

(71) Applicant: Seiko Epson Corporation, Shinjuku-ku (JP)

(72) Inventor: Hiroki Miyajima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/619,710

(22) Filed: Feb. 11, 2015

(65) Prior Publication Data

US 2015/0224770 A1 Aug. 13, 2015

(30) Foreign Application Priority Data

Feb. 13, 2014 (JP) ..... 2014-025484

(51) Int. Cl.
*B41J 2/14* (2006.01)

(52) U.S. Cl.
CPC ..... *B41J 2/1433* (2013.01); *B41J 2/14233* (2013.01); *B41J 2002/14362* (2013.01)

(58) Field of Classification Search
CPC ..... B41J 2/1623; B41J 2/135
USPC ..... 347/47
See application file for complete search history.

(56) References Cited

U.S. PATENT DOCUMENTS 6,003,968 A 12/1999 Kozawa
2002/0063757 A1 5/2002 Kanda et al.
2008/0284819 A1 11/2008 Owaki et al.
2010/0201760 A1* 8/2010 Kanaya ..... 347/85
2012/0242753 A1* 9/2012 Nakao et al. ..... 347/65

FOREIGN PATENT DOCUMENTS

EP 2 255 966 A2 12/2010
JP 2002240303 A * 8/2002
JP 2002-264345 A 9/2002
JP 2004-223877 A 8/2004

OTHER PUBLICATIONS

Extended European search report, dated Jun. 12, 2015, of the corresponding European Application No. 15154647.0; (6 pages).

* cited by examiner

*Primary Examiner* — Julian Huffman
*Assistant Examiner* — Sharon A Polk
(74) *Attorney, Agent, or Firm* — Kilpatrick Townsend & Stockton LLP

(57) ABSTRACT

Two members among a plurality of members are bonded to each other with a hard adhesive. The plurality of members constitute a liquid ejecting head and the members are a member formed of a material other than a resin material and a member with a film shape formed of the resin material. Two members among the plurality of members are bonded to each other with a soft adhesive and the members constitute the flow passage between two members of which at least one is molded with the resin material. Two members among the plurality of members are bonded to each other with a hard adhesive and the members do not constitute the flow passage between two members of which at least one is molded with the resin material.

11 Claims, 3 Drawing Sheets

LIQUID EJECTING HEAD AND LIQUID EJECTING APPARATUS

This application claims priority to Japanese Patent Application No. 2014-025484, filed Feb. 13, 2014, the entirety of which is incorporated by reference herein.

BACKGROUND

1. Technical Field

The present invention relates to a technology of ejecting liquid in a flow passage.

2. Related Art

Various technologies have been proposed in which a plurality of members are bonded to each other to form a flow passage and liquid flowing in the flow passage is ejected from a nozzle. For example, JP-A-2004-223877 discloses a structure in which a plurality of flow passage formation members are bonded to each other with an adhesive to form a flow passage of an ink and the ink in the flow passage is ejected from a nozzle.

In the technology disclosed in JP-A-2004-223877, a silicon-based soft (flexibility) adhesive is used for bonding the plurality of flow passage formation members. However, the soft adhesive generally has a tendency to have high moisture permeability (property of causing moisture to penetrate a substance). Accordingly, there is a problem in that moisture of liquid in a flow passage is evaporated through an adhesive between flow passage formation members. On the other hand, when a hard adhesive having low moisture permeability is used for bonding the respective flow passage formation members, if the flow passage formation member formed of a resin material is deformed (for example, thermally deformed), the adhesive may be separated from the flow passage formation member.

SUMMARY

An advantage of some aspects of the invention is to suppress moisture from being evaporated and to prevent a bonding failure such as separation of an adhesive.

A liquid ejecting head according to a preferable embodiment of the invention includes a plurality of members bonded to each other. The liquid ejecting head is a liquid ejecting head that ejects liquid in a flow passage from a nozzle. Two members among the plurality of members are bonded to each other with a hard adhesive, and the two members are a member formed of a material (for example, metal or silicon) other than a resin material and a film-shaped member formed of the resin material (for example, polyphenylene sulfide). Two members among the plurality of members are bonded to each other with a soft adhesive, and the members constitute the flow passage between two members of which at least one is molded (for example, injection-molded) with the resin material. Two members among the plurality of members are bonded to each other with a soft adhesive, and the members do not constitute the flow passage between two members of which at least one is molded with the resin material. An epoxy-based adhesive is used as a typical example of the hard adhesive. A silicon-based adhesive is used as a typical example of the soft adhesive.

In the above-described configuration, the two members being the member formed of the material other than the resin material and the film-shaped member formed of the resin material are bonded to each other with the hard adhesive regardless of whether or not the flow passage is configured by bonding both of the members. Even when at least one of the two members to be bonded is molded with the resin material, if the two members do not constitute the flow passage, the two members are bonded with the hard adhesive. Generally, the hard adhesive has low moisture permeability. Thus, according to the configuration, evaporation of moisture through the adhesive is suppressed. When at least one of two members to be bonded is molded with the resin material and the flow passage is configured between the two members, the two members are bonded with a soft adhesive. Accordingly, a bonding failure such as separation of an adhesive due to deformation (thermal deformation) of the member molded with the resin material is suppressed.

There is a tendency that a soft adhesive has high moisture permeability compared to a hard adhesive. Considering the tendency, a liquid ejecting head including a structural body is very preferable. The structural body closes a space in which the two members bonded to each other with the soft adhesive are disposed. In the above-described configuration, the space in which the two members bonded to each other with the soft adhesive are disposed is closed by the structural body. Accordingly, it is possible to suppress moisture from being evaporated through the adhesive between the respective members regardless of the configuration in which the soft adhesive is used for bonding the respective members.

A liquid ejecting apparatus according to a preferable embodiment of the invention includes the liquid ejecting head according to the above-described embodiment. As a preferable example of the liquid ejecting apparatus, there is a printing apparatus that ejects an ink. However, a use of the liquid ejecting apparatus according to the invention is not limited to printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Configuration of Printing Apparatus

Figure 1:
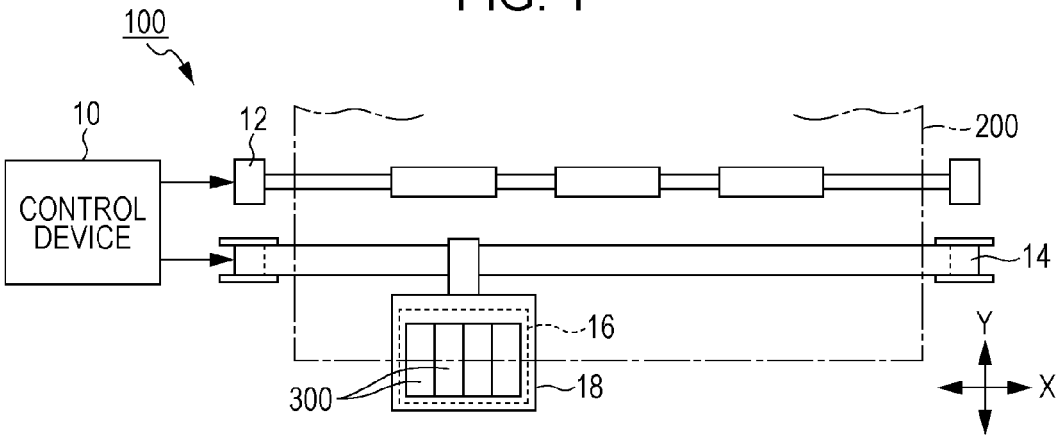
FIG. 1 is a diagram illustrating a configuration of a printing apparatus according to a preferable embodiment of the invention.

FIG. 1 is a diagram partially illustrating a configuration of an ink jet type printing apparatus 100 according to a preferable embodiment of the invention. The printing apparatus 100 is a liquid ejecting apparatus that ejects an ink as an example of a liquid on a printing medium 200 such as a printing paper to form an image on a surface of the printing medium 200. As illustrated in FIG. 1, the printing apparatus 100 includes a control device 10, a transporting mechanism 12, a moving mechanism 14, a liquid ejecting head 16, and a carriage 18.

The control device 10 controls overall components of the printing apparatus 100. The liquid ejecting head 16 is mounted in the carriage 18 along with a plurality of ink cartridges 300 and each cartridge 300 is filled with an ink. The liquid ejecting head 16 ejects the ink supplied from the respective ink cartridges 300 from a plurality of nozzles to the printing medium 200 under control of the control device 10. The transporting mechanism 12 transports the printing medium 200 in a Y direction (sub-scanning direction) under control of the control device 10. The moving mechanism 14 causes the carriage 18 to perform reciprocating in an X direction (main scanning direction) under control of the control device 10. Transporting of the printing medium 200 and reciprocating of the carriage 18 are performed in parallel and the liquid ejecting head 16 ejects the ink on the printing medium 200, thereby forming a desired image on the printing medium 200.

Figure 2:
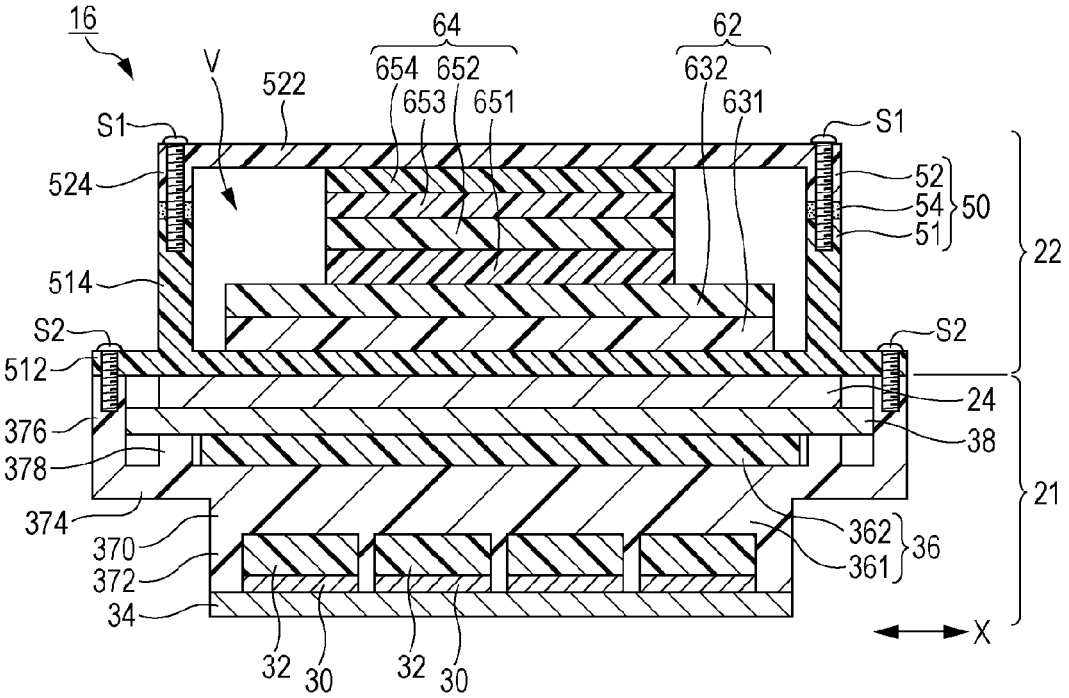
FIG. 2 is a cross-sectional view of a liquid ejecting head.

FIG. 2 is a cross-sectional view (cross-section vertical to the Y direction) of the liquid ejecting head 16. As illustrated in FIG. 2, the liquid ejecting head 16 is configured to include a first structural body 21, a second structural body 22, and a communicating body 24. The first structural body 21 functions to cause the ink to be ejected from the plurality of nozzles. The second structural body 22 functions to causes the ink of the ink cartridge 300 to be supplied to the first structural body 21. The communicating body 24 is formed of an elastic material such as rubber. The communicating body 24 causes a flow passage in the first structural body 21 and a flow passage in the second structural body 22 to communicate with each other. Illustration regarding a specific form of the flow passage for the ink formed in the first structural body 21 and the second structural body 22 is omitted for convenience.

Figure 3:
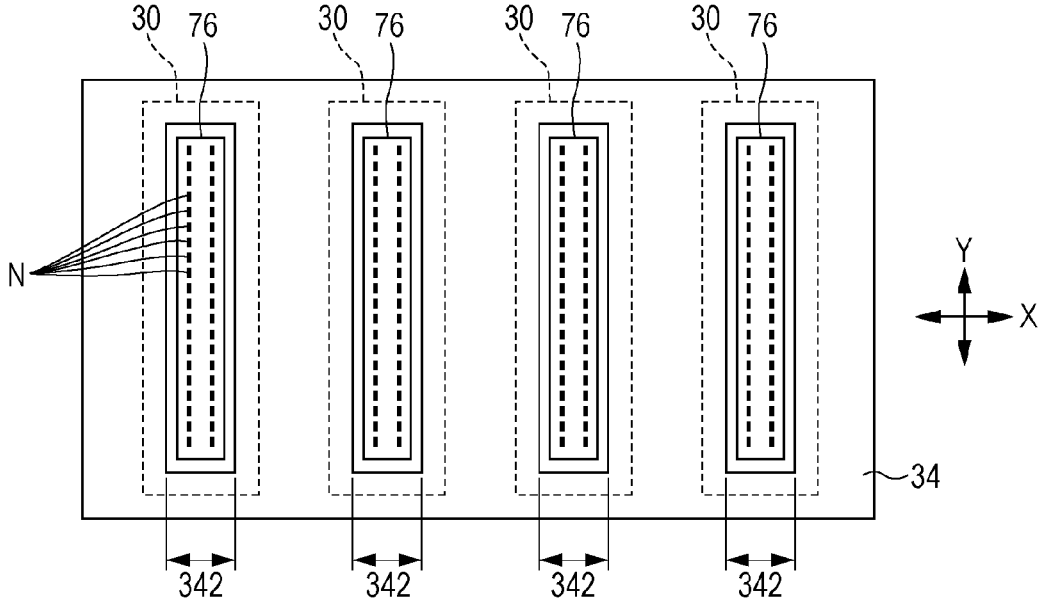
FIG. 3 is a plan view when the liquid ejecting head is viewed from a printing medium.

As illustrated in FIG. 2, the first structural body 21 includes a plurality of head units 30, a plurality of supports 32, a fixation plate 34, a casing member 36, and a control board 38. FIG. 3 is a plan view of the first structural body 21 viewed from a printing medium 200 side. As illustrated in FIG. 3, the plurality of nozzles N arranged in two rows are formed in each of the plurality of head units 30. The plurality of head units 30 are arranged parallel with each other in the X direction such that the plurality of nozzles N are arranged in the Y direction. The head unit 30 ejects the ink from the plurality of nozzles N. The support 32 supports the head unit 30.

Figure 4:
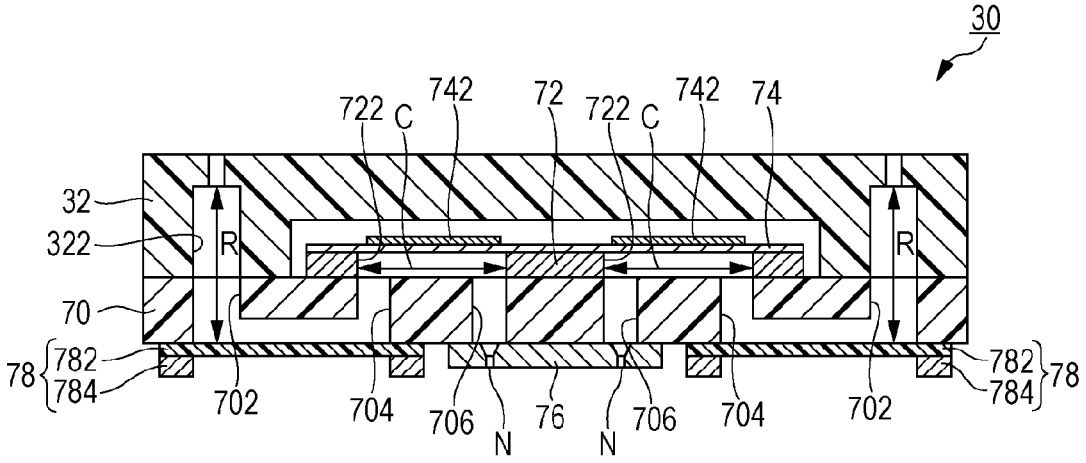
FIG. 4 is an enlarged cross-sectional view of a head unit and a support.
Figure 5:
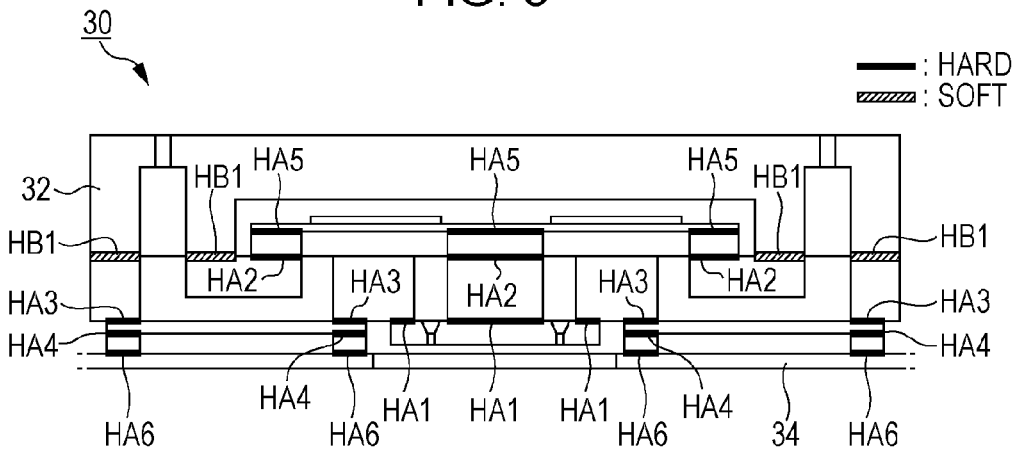
FIG. 5 is a diagram illustrating an adhesive for bonding members of the head unit and the support.

FIG. 4 is a cross-sectional view in which one arbitrary set of the head unit 30 and the support 32 is enlarged. FIG. 5 is a cross-sectional view focused on an adhesive used for bonding the respective members illustrated in FIG. 4. From the viewpoint of suppressing the drawing from being complicatedly illustrated, for convenience, illustration of the adhesive is omitted in FIG. 4 and hatching patterns of components in FIG. 4 are omitted in FIG. 5.

As illustrated in FIG. 4, the head unit 30 according to the embodiment is a head chip in which a pressure chamber formation plate 72 and a vibrating plate 74 are stacked on a surface of the flow passage formation plate 70 on one side thereof, and a nozzle plate 76 and a compliance board 78 are installed on a surface of the flow passage formation plate 70 on another side thereof. As understood through FIG. 4, configurations corresponding to the respective arrangements of the nozzles N are formed in the one head unit 30 to have a substantially axial symmetric shape. Hereinafter, for convenience, a structure of the head unit 30 will be described focused on a portion corresponding to one row of the nozzles N.

The nozzle plate 76 is a plate member on which the plurality of nozzles N are formed to form two rows. The nozzle plate 76 according to the embodiment is formed of silicon. The flow passage formation plate 70 and the nozzle plate 76 are bonded to each other with an adhesive HA1 illustrated in FIG. 5.

The flow passage formation plate 70 is a plate member constituting a flow passage of the ink. Openings 702, a plurality of supply flow passages 704, and a plurality of communication flow passages 706 are formed in the flow passage formation plate 70 according to the embodiment. The supply flow passage 704 and the communication flow passage 706 are formed for each nozzle N. The openings 702 are formed to continue over the plurality of nozzles N. The pressure chamber formation plate 72 is a plate member in which a plurality of openings 722 respectively corresponding to the nozzles N different from each other are formed. The flow passage formation plate 70 and the pressure chamber formation plate 72 according to the embodiment are formed of silicon and bonded to each other with an adhesive HA2 illustrated in FIG. 5.

A compliance board 78 in FIG. 4 is a component of suppressing (absorbing) pressure fluctuation inside the flow passage. The compliance board 78 is configured to include a sealing plate 782 and a support 784. The sealing plate 782 is a film-shaped (layer-shaped) member having flexibility. The sealing plate 782 is formed of a resin material such as polyphenylene sulfide (PPS: Polyphenylenesulfide). The support 784 is formed of metal such as stainless steel (for example, SUS403 or SUS430). The support 784 causes the sealing plate 782 to be fixed to the flow passage formation plate 70 such that the openings 702 and the respective supply flow passages 704 of the flow passage formation plate 70 are closed. The flow passage formation plate 70 and the sealing plate 782 are bonded to each other with an adhesive HA3 illustrated in FIG. 5. The sealing plate 782 and the support 784 are bonded to each other with an adhesive HA4 illustrated in FIG. 5.

A vibrating plate 74 is installed on a surface of the pressure chamber formation plate 72 in FIG. 4 on a side opposite to the flow passage formation plate 70. The vibrating plate 74 and the pressure chamber formation plate 72 are bonded to each other with an adhesive HA5 illustrated in FIG. 5. The vibrating plate 74 is a plate-shaped member capable of vibrating elastically. The vibrating plate 74 is configured by stacking an elastic layer and an insulating layer. The elastic layer is formed of an elastic material such as silicon oxide and the insulating layer is formed of an insulating material such as zirconium oxide. As understood through FIG. 4, the vibrating plate 74 and the flow passage formation plate 70 face each other with a predefined distance in the respective opening 722 formed in the pressure chamber formation plate 72. A space in the respective opening 722 interposed between the flow passage formation plate 70 and the vibrating plate 74 functions as a pressure chamber (cavity) C giving the ink pressure.

A plurality of piezoelectric elements 742 respectively corresponding to the nozzles N different from each other are formed on a surface of the vibrating plate 74 on a side opposite to the pressure chamber formation plate 72. The piezoelectric element 742 is a stacked object obtained by interposition of a piezoelectric substance between electrodes which face each other. Supply of a driving signal causes the piezoelectric element 742 to vibrate along with the vibrating plate 74. Thus, pressure in the pressure chamber C fluctuates and the ink in the pressure chamber C is ejected from the nozzle N.

As illustrated in FIG. 4, the support 32 is fixed to the flow passage formation plate 70 (head unit 30). The support 32 is integrally formed by molding with a resin material (for example, injection molding). A resin material (thermoplastic resin) such as an acryl-based resin, an ABS-based resin, or an epoxy-based resin is preferably used as a material of a component of the liquid ejecting head 16, and the component is formed by molding, similarly to the support 32. The flow passage formation plate 70 and the support 32 are bonded to each other with an adhesive HB1 illustrated in FIG. 5. As illustrated in FIG. 4, a liquid flow passage 322 is formed in the support 32 according to the embodiment. As understood through FIG. 4, a space of causing the opening 702 of the flow passage formation plate 70 and the liquid flow passage 322 of the support 32 to communicate with each other functions as a liquid storage chamber (reservoir) R. Each of the supply flow passages 704 in the flow passage formation plate 70 causes the liquid storage chamber (reservoir) R and the pressure chamber C to communicate with each other. Each of the communication flow passages 706 in the flow passage formation plate 70 causes the pressure chamber C and the nozzle N to communicate with each other. As understood through the above description, the ink stored in the liquid storage chamber (reservoir) R is divided to be supplied to the respective pressure chambers C in parallel through the plurality of supply flow passages 704. The ink passes through the communication flow passage 706 and the nozzle N from the respective pressure chambers C and is ejected outwardly. That is, the flow passage formation plate 70, the pressure chamber formation plate 72, the nozzle plate 76, the vibrating plate 74, the compliance board 78 (sealing plate 782), and the support 32 form a flow passage of the ink.

The fixation plate 34 in FIG. 2 is a plate member formed of, for example, metal (stainless steel such as SUS403 and SUS430) having high rigidity. As illustrated in FIG. 3, a plurality of openings 342 are formed in the fixation plate 34. Each of the plurality of head units 30 is fixed to a surface of the fixation plate 34 in a state where the nozzle plate 76 is positioned inside the opening 342. An adhesive HA6 illustrated in FIG. 5 is used for bonding the respective head units 30 and the fixation plate 34. Specifically, the fixation plate 34 and the support 784 of the compliance board 78 are bonded to each other with the adhesive HA6.

The casing member 36 in FIG. 2 supports the plurality of supports 32 (head units 30) and the control board 38 and constitutes a flow passage supplying the ink to the respective head units 30. The casing member 36 according to the embodiment is configured to include a first member 361 and a second member 362. The first member 361 is a structural body including a foundation portion 370, a holding portion 372, protruding portions 374, and side wall portions 376 and is integrally formed by molding (for example, injection molding) with a resin material. The foundation portion 370 and the second member 362 constitute a flow passage used for supplying the ink in the liquid storage chamber (reservoir) R of the head unit 30. The holding portion 372 is a wall-shaped part protruding to a side (printing medium 200 side) opposite to the second structural body 22 from a circumference of the foundation portion 370. The protruding portion 374 is a part put outwardly from the circumference of the foundation portion 370. The side wall portion 376 is a wall-shaped part protruding to a second structural body 22 side from a circumference of the protruding portion 374.

Figure 6:
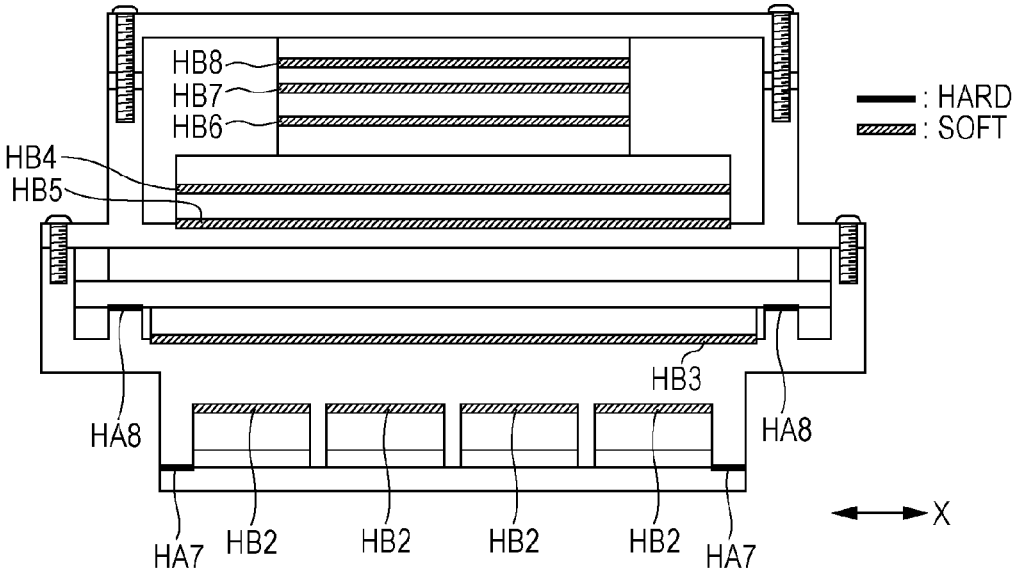
FIG. 6 is a diagram illustrating an adhesive for bonding members of the liquid ejecting head.

FIG. 6 is a cross-sectional view focused on an adhesive used for bonding the respective members illustrated in FIG. 2. Hatching patterns of the components illustrated in FIG. 2 are omitted in FIG. 5, for convenience. As illustrated in FIG. 2, the plurality of supports 32 (head units 30) are disposed in a space surrounded by the holding portion 372 and fixed to the foundation portion 370. The respective supports 32 and the foundation portion 370 are bonded to each other with an adhesive HB2 illustrated in FIG. 6. The top surface of the holding portion 372 is fixed to the surface of the fixation plate 34 along with the head units 30. Specifically, the holding portion 372 and the fixation plate 34 are bonded to each other with an adhesive HA7 illustrated in FIG. 6.

The second member 362 in FIG. 2 is a component which cooperates with the first member 361 (foundation portion 370) to form a flow passage of supplying the ink to the respective head units 30. The second member 362 and the first member 361 are integrally formed by molding (for example, injection molding) with a resin material. The second member 362 is fixed to the first member 361 (foundation portion 370). Specifically, the second member 362 and the foundation portion 370 are bonded to each other with an adhesive HB3 illustrated in FIG. 6.

The control board 38 in FIG. 2 is a wiring board on which wiring supplying the driving signal or an electric power potential to the respective head units 30 or a driving circuit generating the driving signal is mounted. The driving signal or the electric power potential is supplied from the control board 38 to the respective head units 30 through a flexible wiring board (not illustrated) over the respective head units 30 and the control board 38.

Board supports 378 are formed in the protruding portion 374 of the first member 361. The board support 378 is a protrusion formed with a rectangular frame shape surrounding the second member 362 in a plan view. The control board 38 is disposed in a space surrounded by the side wall portion 376 and is fixed to the top surfaces of the board supports 378. Specifically, the control board 38 and the board support 378 are bonded to each other with an adhesive HA8 illustrated in FIG. 6. A flow passage in the communicating body 24 communicates with a flow passage in the casing member 36 through a through hole (not illustrated) formed in the control board 38.

The second structural body 22 in FIG. 2 is configured to include a housing 50, a filter assembly 62, and a valve assembly 64. The housing 50 is a hollow case configured by a first housing portion 51, a second housing portion 52, and a seal member 54. The first housing portion 51 and the second housing portion 52 are bonded to each other in a state where the seal member 54 is interposed between the first housing portion 51 and the second housing portion 52 to form a space V. The filter assembly 62 and the valve assembly 64 are accommodated in and supported by the space V in the housing 50.

The first housing portion 51 is a structural body with a shape for including a planar portion 512 and side portions 514 and is integrally formed by molding with, for example, a resin material. The planar portion 512 is a part with a substantially rectangular plate shape. The side portion 514 is a wall-shaped part protruding from a surface of the planar portion 512 to the second housing portion 52. The side portion 514 is formed with a substantially rectangular frame shape in a plan view. The second housing portion 52 is a structural body with a shape for including a planar portion 522 and side portions 524. Similarly to the first housing portion 51, the second housing portion 52 is integrally formed by molding with a resin material. The planar portion 522 is a part with a substantially rectangular frame shape. The side portion 524 is a part with a rectangular frame shape protruding from a surface of the planar portion 522 to the first housing portion 51.

The first housing portion 51 and the second housing portion 52 are fixed to each other with a plurality of screws S1 in a state where the seal member 54 is interposed between the side portion 514 of the first housing portion 51 and the side portion 524 of the second housing portion 52. The casing member 36 (side wall portion 376) of the first structural body 21 and the first housing portion 51 (planar portion 512) of the second structural body 22 are fixed to each other using a plurality of screws S2. If the first structural body 21 and the second structural body 22 are fixed to each other, the communicating body 24 is supported between the casing member 36 and the first housing portion 51 in a state of being pressed from the casing member 36 and the first housing portion 51 by the casing member 36 and the first housing portion 51.

The filter assembly 62 is configured to include a plurality of flow passage members 63 (631 and 632) and is fixed to the planar portion 512 of the first housing portion 51. The flow passage member 63 is molded with a resin material, for example. A filter (not illustrated) is supported between the flow passage member 631 and the flow passage member 632. The filter functions to causes the ink supplied from the ink cartridge 300 to the respective head units 30 to pass through the filter and to remove bubbles or foreign substances. A flow passage joining an upstream side and a downstream side of the filter is configured by bonding the respective flow passage members 63. The flow passage member 631 and the flow passage member 632 are bonded to each other with an adhesive HB4 illustrated in FIG. 6. The filter assembly 62 (flow passage member 631) and the planar portion 512 of the first housing portion 51 are bonded to each other with an adhesive HB5 illustrated in FIG. 6.

The valve assembly 64 in FIG. 2 is configured by stacking a plurality of flow passage members 65 (651 to 654). The flow passage member 65 is molded of a resin material, for example. A regulating valve (for example, a self-sealing valve and a back pressure control valve) and a flow passage are formed in the valve assembly 64 according to the embodiment, the regulating valve controls pressure of the ink supplied from the ink cartridge 300, and the flow passage joins an upstream side and a downstream side of the regulating valve. The respective flow passage members 65 of the valve assembly 64 are bonded to each other with adhesives HB6 to HB8 illustrated in FIG. 6. The first housing portion 51 and the second housing portion 52 are fixed to each other with the plurality of screws S1 through the seal member 54 such that the valve assembly 64 is held between the planar portion 522 of the second housing portion 52 and the filter assembly 62.

In the embodiment, two types of adhesives, that is, a soft (flexibility) adhesive and a hard (rigidity) adhesive are used for bonding the respective members constituting the liquid ejecting head 16. The soft adhesive is an adhesive having characteristics in which a degree of hardness after hardening (after drying) is lower than a degree of hardness of a hard adhesive. The soft adhesive is able to be deformed elastically depending on exterior stress. Specifically, there is a silicon-based adhesive as a preferable example of the soft adhesive and there is an epoxy-based adhesive as a preferable example of the hard adhesive. There is a tendency in that the soft adhesive has high moisture permeability compared to the hard adhesive (that is, moisture is likely to be evaporated through the adhesive). As illustrated in FIG. 5 and FIG. 6, in the embodiment, the adhesives HA (HA1 to HA8) are the hard adhesives and the adhesives HB (HB1 to HB8) are the soft adhesives. Conditions of using the hard adhesive and the soft adhesive will be described below in detail.

First, when both of two members to be bonded are members formed of a material (for example, metal or silicon) other than a resin material, the hard adhesive is used for bonding the two members, regardless of the presence or absence of a flow passage between the two members. For example, in the embodiment, since the flow passage formation plate 70, the nozzle plate 76, and the pressure chamber formation plate 72 are formed of silicon (non-resin material), the adhesive HA1 and the adhesive HA2 are the hard adhesives. The adhesive HA1 is used for bonding the flow passage formation plate 70 and the nozzle plate 76. The adhesive HA2 is used for bonding the flow passage formation plate 70 and the pressure chamber formation plate 72. Similarly, the adhesive HA5 used for bonding the vibrating plate 74 and the pressure chamber formation plate 72 is also the hard adhesive. Since the support 784 of the compliance board 78 and the fixation plate 34 are formed of metal such as stainless steel, the adhesive HA6 used for the support 784 and the fixation plate 34 is the hard adhesive.

Second, when two members to be bonded are a member formed of a material other than a resin material and a film-shaped member formed of a resin material (for example, polyphenylene sulfide), the hard adhesive is used for bonding the two members. Specifically, the adhesive HA3 and the adhesive HA4 are the hard adhesives. The adhesive HA3 is used for bonding the sealing plate 782 of the compliance board 78 and the flow passage formation plate 70 formed of silicon and the sealing plate 782 is formed of a resin material and film-shaped. The adhesive HA4 is used for bonding the sealing plate 782 and the support 784.

Third, when at least one of two members to be bonded is formed by molding (for example, injection-molding) with a resin material, it is determined which adhesive of the hard adhesive and the soft adhesive is used based on whether or not the members constitute a flow passage of the ink. Specifically, when two members including a member molded with a resin material do not constitute the flow passage of the ink, the hard adhesive is used for bonding the two members. For example, the first member 361 of the casing member 36, which is bonded to the fixation plate 34 in FIG. 2 is molded with a resin material. However, a flow passage is not configured by bonding the fixation plate 34 and the first member 361. Thus, the adhesive HA7 used for bonding the fixation plate 34 and the first member 361 (holding portion 372) of the casing member 36 is the hard adhesive. The first member 361 (board support 378) bonded to the control board 38 is molded with a resin material. However, a flow passage is not configured by bonding the first member 361 and the control board 38. Thus, the adhesive HA8 used for bonding the first member 361 and the control board 38 is hard.

On the other hand, when two members including a member molded with a resin material constitute the flow passage of the ink, the soft adhesive is used for bonding the two members. For example, since the support 32 bonded to the flow passage formation plate 70 is molded with a resin material and a flow passage (liquid storage chamber R) is configured by bonding the flow passage formation plate 70 and the support 32, the adhesive HB1 used for bonding the flow passage formation plate 70 and the support 32 is soft. The adhesive HB2 and the adhesive HB3 are the soft adhesives, similarly. The adhesive HB2 is used for bonding the respective supports 32 and the first member 361 (foundation portion 370) of the casing member 36. The adhesive HB3 is used for bonding the first member 361 and the second member 362.

Similarly, since the flow passage member 631 of the filter assembly 62 and the flow passage member 632 are molded with a resin material and the flow passage joining the upstream side and the downstream side of the filter is configured by bonding both of the members, the adhesive HB4 used for bonding the flow passage member 631 and the flow passage member 632 is soft. Similarly, since the flow passage member 632 and the first housing portion 51 (planar portion 512) are molded with a resin material and a flow passage reaching the communicating body 24 from the filter assembly 62 is configured by bonding both of the members, the adhesive HB5 used for bonding the flow passage member 632 and the first housing portion 51 is soft. Furthermore, since the flow passage members 65 of the valve assembly 64 are molded with a resin material and the flow passage joining the upstream side and the downstream side of the regulating valve is configured by bonding the members, the adhesives HB6 to HB8 used for bonding the respective flow passage members 65 are soft.

As described above, in the embodiment, the two members of the member formed of a material (for example, metal and silicon) other than a resin material and the film-shaped member formed of a resin material are bonded to each other with the hard adhesives HA (HA1 to HA6) having relatively low moisture permeability, regardless of whether or not a flow passage is configured by bonding the two members. Even when one or both of the two members to be bonded is molded with a resin material, if a flow passage is not configured between both of the members, the hard adhesives HA (HA7 and HA8) are used. Accordingly, it is possible to suppress moisture from being evaporated through the adhesives HA. When one or both of the two members to be bonded is molded with a resin material, if a flow passage is configured between both of the members, the soft adhesives HB (HB1 to HB8) are used for bonding both of the members. Accordingly, it is possible to prevent bonding failure such as separation of the adhesives HB from occurring due to deformation (for example, thermal deformation) of the member molded with a resin material. As is understood through the above description, in the embodiment, since the hard adhesives HA and the soft adhesives HB are properly used, there is an advantage in that suppression of moisture evaporation and prevention of bonding failure such as separation of the adhesive are achieved, compared to a configuration in which only one of the hard adhesive and the soft adhesive is used.

The soft adhesives HB have high moisture permeability compared to the hard adhesives HA. Accordingly, moisture in the filter assembly 62 may be evaporated through the adhesive HB4 between the flow passage member 631 and the flow passage member 632 of the filter assembly 62. In addition, moisture in the valve assembly 64 may be evaporated through the adhesives HB6 to HB8 between the flow passage members 65 of the valve assembly 64. However, in the embodiment, the space V is closed by the housing 50 and, in the space V, components (filter assembly 62 and valve assembly 64) bonded by using the soft adhesives HB are present. Accordingly, moisture is effectively suppressed from being evaporated from the filter assembly 62 or the valve assembly 64, regardless of the configuration in which the soft adhesives HB are used for bonding the members.

Modification Example

The above-described embodiment may be variously modified. A specific modification embodiment will be described below. Two or more embodiments arbitrarily selected from examples which will be described below may be appropriately combined within a range of not contradicting each other.

(1) In the above-described embodiment, both of the filter assembly 62 and the valve assembly 64 are accommodated in the housing 50. However, one of the filter assembly 62 and the valve assembly 64 may be omitted (or be installed outside the housing 50).

(2) In the above-described embodiment, the members of the liquid ejecting head 16 adhere to each other with the adhesive. However, the members may be bonded to each other by using other methods, in addition to adhering with an adhesive. For example, the respective flow passage members 63 of the filter assembly 62 or the respective flow passage members 65 of the valve assembly 64 may be bonded to each other with a bonding tool such as a screw and a fastening tool along with adhering to each other with the adhesive.

(3) The method in which the liquid ejecting head 16 ejects the ink is not limited to the above-described method (piezo-type) using the piezoelectric element 742. For example, the invention may be also applied to a liquid ejecting head 16 using a method (thermo-type) in which a heating element generates heat to cause bubbles in the pressure chamber C to be generated, thereby changing pressure in the pressure chamber C. In the above-described embodiment, a serial type printing apparatus 100 is described in which the liquid ejecting head 16 is mounted in the carriage 18 and caused to perform reciprocating. However, the invention may be also applied to a line type printing apparatus in which a plurality of liquid ejecting heads 16 are arranged in the width direction (Y direction) of the printing medium 200.

(4) The printing apparatus 100 described in the respective embodiments may also be employed to various equipment such as a facsimile apparatus and a copier in addition to equipment dedicated to printing. The use of the liquid ejecting apparatus according to the invention is not limited to printing. For example, a liquid ejecting apparatus of ejecting a solution containing a coloring material is used as a manufacturing apparatus of forming a color filter used in a liquid crystal display apparatus. A liquid ejecting apparatus of ejecting a solution containing a conductive material is used as a manufacturing apparatus of forming wiring of a wiring board or an electrode.

What is claimed is:

1. A liquid ejecting head that ejects liquid in a flow passage from a nozzle, the liquid ejecting head comprising:

a plurality of members bonded to each other, wherein a first pair of members among the plurality of members are bonded to each other with a hard adhesive, the first pair of members including a member formed of a material other than a resin material and a film-shaped member formed of the resin material, a second pair of members among the plurality of members are bonded to each other with a soft adhesive, the flow passage being formed between the second pair of members of which at least one is molded with the resin material, and a third pair of members among the plurality of members are bonded to each other with a hard adhesive, no flow passage being formed between the third pair of members of which at least one is molded with the resin material.

2. The liquid ejecting head according to claim 1, wherein the material other than the resin material is metal or silicon and the film-shaped member is formed of polyphenylene sulfide.

3. The liquid ejecting head according to claim 1, wherein the soft adhesive has high moisture permeability compared to the hard adhesive.

4. The liquid ejecting head according to claim 1, further comprising:

a structural body enclosing a space in which the second pair of members bonded to each other with the soft adhesive are disposed.

5. The liquid ejecting head according to claim 1, wherein the hard adhesive is an epoxy-based adhesive and the soft adhesive is a silicon-based adhesive.

6. The liquid ejecting head according to claim 1, wherein the soft adhesive is an adhesive having characteristics in which a degree of hardness after hardening is lower than a degree of hardness of the hard adhesive.

7. A liquid ejecting apparatus comprising:

a liquid ejecting head that ejects liquid in a flow passage from a nozzle, the liquid ejecting head comprising:

a plurality of members bonded to each other, wherein a first pair of members among the plurality of members are bonded to each other with a hard adhesive, the first pair of members including a member formed of a material other than a resin material and a film-shaped member formed of the resin material, a second pair of members among the plurality of members are bonded to each other with a soft adhesive, the flow passage being formed between the second pair of members of which at least one is molded with the resin material, and a third pair of members among the plurality of members are bonded to each other with a hard adhesive, no flow passage being formed between the third pair of members of which at least one is molded with the resin material.

8. The liquid ejecting apparatus according to claim 7, wherein the material other than the resin material is metal or silicon and the film-shaped member is formed of polyphenylene sulfide.

9. The liquid ejecting apparatus according to claim 7, wherein the soft adhesive has high moisture permeability compared to the hard adhesive.

10. The liquid ejecting apparatus according to claim 7, wherein the liquid ejecting head further comprises:

a structural body enclosing a space in which the second pair of members bonded to each other with the soft adhesive are disposed.

11. The liquid ejecting apparatus according to claim 7, wherein the hard adhesive is an epoxy-based adhesive and the soft adhesive is a silicon-based adhesive.

* * * * *